US005642828A

United States Patent [19]

Sorens

[11] Patent Number: 5,642,828

[45] Date of Patent: Jul. 1, 1997

[54] REFUSE CONTAINER ATTACHMENT APPARATUS

[76] Inventor: Andris P. Sorens, 992 E 21st Pl., Tulsa, Okla. 74129

[21] Appl. No.: 688,193

[22] Filed: Jun. 29, 1996

[51] Int. Cl.[6] ..... B65D 21/02

[52] U.S. Cl. ..... 220/4.03; 220/908; 141/331

[58] Field of Search ..... 220/4.03, 908, 220/909, 503, 352, 353

[56] References Cited

U.S. PATENT DOCUMENTS

| | | | |
|---|---|---|---|
| D. 334,448 | 3/1993 | Fish . | |
| 3,749,908 | 7/1973 | Esser et al. | 220/4.03 |
| 4,776,477 | 10/1988 | Walker | 220/4.03 |
| 4,852,757 | 8/1989 | Gold | 220/4.03 |
| 4,964,523 | 10/1990 | Bieltvedt et al. . | |
| 5,123,562 | 6/1992 | Bullard et al. . | |
| 5,183,175 | 2/1993 | Brown . | |
| 5,207,344 | 5/1993 | Davies et al. . | |
| 5,447,251 | 9/1995 | Taylor . | |
| 5,573,131 | 11/1996 | Berjis | 220/4.03 |

*Primary Examiner*—Joseph M. Moy

[57] ABSTRACT

An apparatus for attachment to the top container rim of a container includes a central base unit which includes a base center portion, an outer base wall downwardly depending from an outer side of the base center portion, and an inner base wall downwardly depending from an inner side of the base center portion. The attachment apparatus also includes a first side unit and a second side unit which are to opposite ends of the central base unit. The first side unit slopes downwardly toward the second side unit, and the second side unit slopes downwardly toward the first side unit. The inner base wall of the base center portion slopes downwardly toward the front ends of the first side unit and the second side unit. The outer base wall, the base center portion, and the inner base wall form an inverted U-shaped channel for fitting over a top container rim of a container. A center deflector wall is connected to the base center portion and depends upwardly therefrom. The center deflector wall slopes upwardly toward front ends of the first side unit and the second side unit. A first side deflector wall is connected to the first side unit and depends upwardly therefrom. A second side deflector wall is connected to the second side unit and depends upwardly therefrom. A pair of clamp assemblies are connected to the central base unit. A pair of carry handles are connected to the center deflector wall.

11 Claims, 3 Drawing Sheets

FIG 3
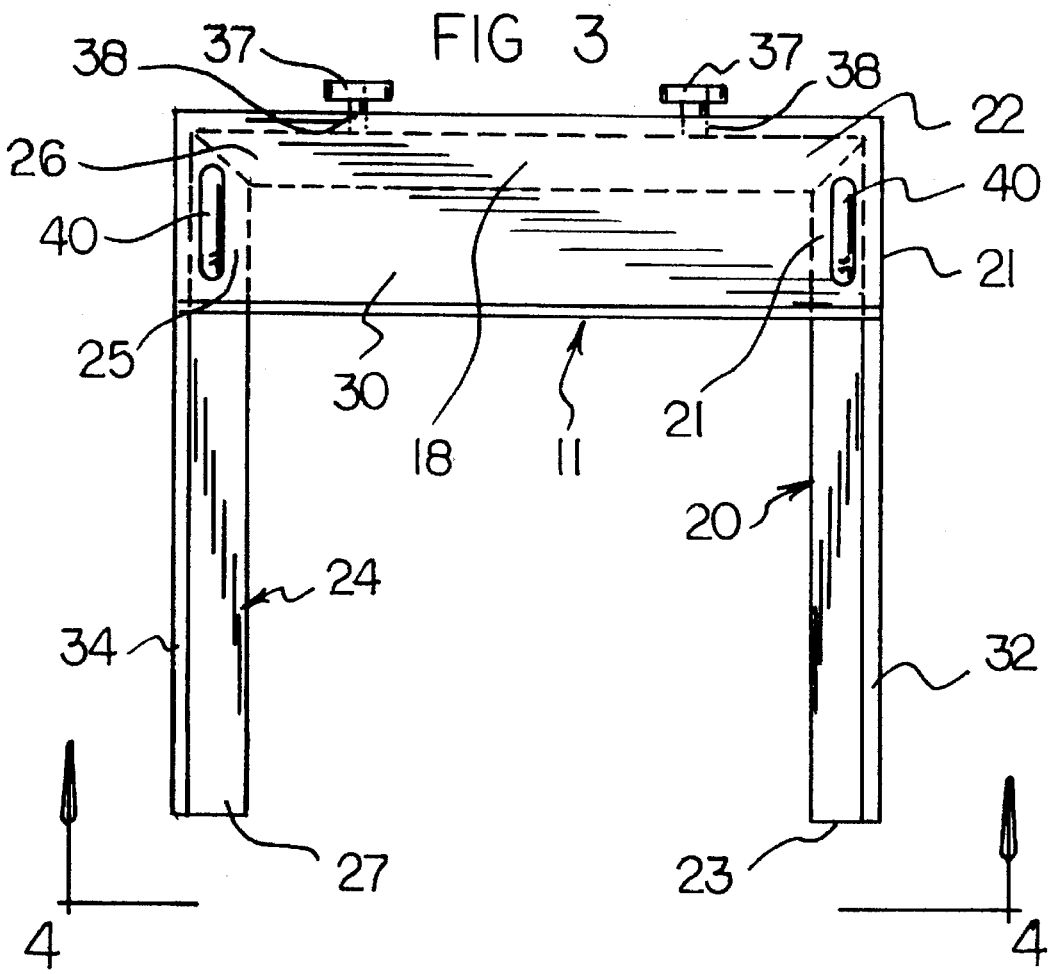
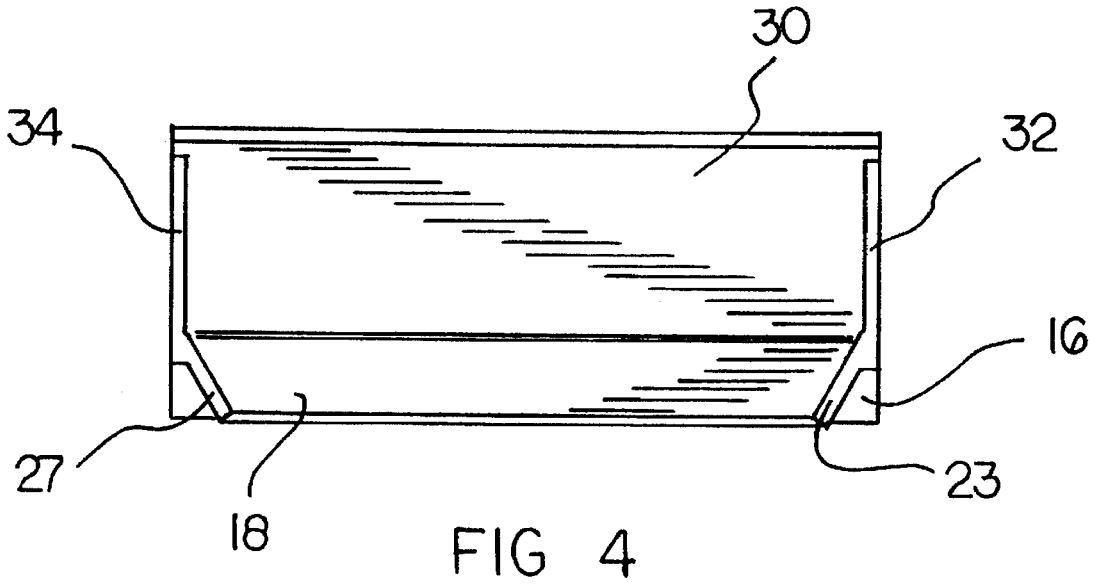
FIG 4

REFUSE CONTAINER ATTACHMENT APPARATUS

BACKGROUND OF THE INVENTION

1. Field of the Invention

The present invention relates generally to refuse containers and, more particularly, to refuse containers that are customarily housed inside decorative housings.

2. Description of the Prior Art

In many business establishments, especially establishments in the food business, refuse containers are housed inside decorative housings. Often a decorative housing has a swinging door which permits access to a refuse container contained within the decorative housing. When the swinging door is swung open and refuse is dumped towards the refuse container, a small portion of the refuse often misses the refuse container and lands on an inside wall of the decorative housing. Although the refuse container itself may be readily cleaned, it is a more difficult task to the inside walls of the decorative housing. Because the inside walls of the decorative housing are not readily cleaned, they are not cleaned very often, especially in a fast-paced work environment such as a fast food business establishment. Often, the inside surfaces of the decorative housings for the refuse containers are not cleaned in weeks. As a result, they have an accumulation of dried soil. It may take extended periods of time to clean these soiled inside surfaces of the decorative housings.

Every food establishment receives health inspections. In addition, food establishments often receive performance evaluations from their company. The inside surfaces of decorative housings of refuse containers are often inspected. In this respect, it would be desirable if means were provided for impeding or preventing accumulation of refuse or soil on inside walls of decorative housings for refuse containers.

Moreover, as stated above, the cleaning of dried soil, that accumulates over time inside the decorative housings for refuse containers, is a time consuming process. In this respect, it would be desirable if means were provided for reducing the amount of time spent for cleaning the inside walls of the decorative housings for refuse containers.

Throughout the years, a number of innovations have been developed relating to refuse containers, and the following U.S. patents are representative of some of those innovations: 4,964,523, 5,123,562, 5,183,175, 5,207,344, 5,447,251, and Des. 334,448. It is noted that none of the cited patents disclose either means for impeding or preventing accumulation of refuse or soil on inside walls of decorative housings for refuse containers or for reducing the amount of time spent for cleaning the inside walls of the decorative housings for refuse containers.

Still other features would be desirable in a device for impeding or preventing accumulation of refuse or soil on inside walls of decorative housings for refuse containers. For example, a certain amount of refuse lands on the top rim of the refuse container. Some of such refuse falls into the container, and some of the refuse may fall outside of the container. The refuse that falls outside of the refuse container may land on the side walls or the floor of the decorative housing. To lessen the amount of refuse that falls outside of the container, it would be desirable if means were provided which fit over the top rim of a refuse container and funnel refuse into the refuse container.

When refuse is deposited in a refuse container retained in a decorative housing, there is a great tendency for some refuse to completely overshoot the top rim of the refuse container and land upon an inside wall of the decorative housing. In this respect, it would be desirable if means were provided to deflect refuse that overshoots the top rim of the refuse container into the interior of the refuse container.

For purposes of sanitation, it would be desirable if means for deflecting refuse into a refuse container were easily removed from the refuse container for washing. Similarly, it would be desirable if means for deflecting refuse into a refuse container were easily clamped onto a refuse container.

Since it would be desirable for the refuse deflection means to be washed often, it would also be desirable if handles were provided on the refuse deflection means so that the refuse deflection means could be readily carried to and from a site where washing was conducted.

Thus, while the foregoing body of prior art indicates it to be well known to use collection devices for refuse, the prior art described above does not teach or suggest a refuse container attachment apparatus which has the following combination of desirable features: (1) impedes or prevents accumulation of refuse or soil on inside walls of decorative housings for refuse containers; (2) reduces the amount of time spent for cleaning the inside walls of the decorative housings for refuse containers; (3) fits over the top rim of a refuse container and funnels refuse into the refuse container; (4) deflects refuse that overshoots the top rim of the refuse container into the interior of the refuse container; (5) is easily removed from the refuse container for washing; (6) is easily clamped onto a refuse container; and (7) has handles so that refuse deflection means can be readily carried to and from a site where washing is conducted. The foregoing desired characteristics are provided by the unique refuse container attachment apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an apparatus for attachment to the top container rim of a container. The apparatus includes a central base unit which includes a base center portion, an outer base wall downwardly depending from an outer side of the base center portion, and an inner base wall downwardly depending from an inner side of the base center portion. The attachment apparatus also includes a first side unit which includes a rear end and a front end, and the rear end of the first side unit is connected to a first end of the central base unit. The attachment apparatus also includes a second side unit which includes a rear end and a front end, and the rear end of the second side unit is connected to a second end of the central base unit. The first side unit slopes downwardly toward the second side unit, and the second side unit slopes downwardly toward the first side unit. The inner base wall of the base center portion slopes downwardly toward the front ends of the first side unit and the second side unit. The outer base wall, the base center portion, and the inner base wall form an inverted U-shaped channel for fitting over a top container rim of a container.

A center deflector wall is connected to the base center portion and depends upwardly therefrom. The center deflector wall slopes upwardly toward the front ends of the first side unit and the second side unit. A first side deflector wall is connected to the first side unit and depends upwardly therefrom. A second side deflector wall is connected to the second side unit and depends upwardly therefrom. The central base unit, the first side unit, and the second side unit are formed as a unified, integrated structure.

A clamp assembly is connected to the central base unit. The clamp assembly includes a screw clamp unit which includes a handle portion and a threaded shaft portion which is connected to the handle portion. A threaded clamp-receiving channel located in the outer base wall of the central base unit. The threaded clamp-receiving channel receives the threaded shaft portion of the screw clamp unit. The clamp assembly further includes a pressure plate located at a distal end of the threaded shaft portion. A carry handle is connected to the center deflector wall.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved refuse container attachment apparatus which has all of the advantages of the prior art and none of the disadvantages.

It is another object of the present invention to provide a new and improved refuse container attachment apparatus which may be easily and efficiently manufactured and marketed.

It is a further object of the present invention to provide a new and improved refuse container attachment apparatus which is of durable and reliable construction.

An even further object of the present invention is to provide a new and improved refuse container attachment apparatus which is susceptible of a low cost of manufacture with regard to both materials and labor, and which accordingly is then susceptible of low prices of sale to the consuming public, thereby making such refuse container attachment apparatus available to the buying public.

Still yet a further object of the present invention is to provide a new and improved refuse container attachment apparatus which impedes or prevents accumulation of refuse or soil on inside walls of decorative housings for refuse containers.

Still another object of the present invention is to provide a new and improved refuse container attachment apparatus that reduces the mount of time spent for cleaning the inside walls of the decorative housings for refuse containers.

Yet another object of the present invention is to provide a new and improved refuse container attachment apparatus which fits over the top rim of a refuse container and funnels refuse into the refuse container.

Even another object of the present invention is to provide a new and improved refuse container attachment apparatus that deflects refuse that overshoots the top rim of the refuse container into the interior of the refuse container.

Still a further object of the present invention is to provide a new and improved refuse container attachment apparatus which is easily removed from the refuse container for washing.

Yet another object of the present invention is to provide a new and improved refuse container attachment apparatus that is easily clamped onto a refuse container.

Still another object of the present invention is to provide a new and improved refuse container attachment apparatus which has handles so that refuse deflection means can be readily carried to and from a site where washing is conducted.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a top view of the embodiment of the invention shown in FIG. 2 removed from the refuse container.

FIG. 4 is a front view of the embodiment of the invention shown in FIG. 3 taken along lines 4—4 of FIG. 3.

DESCRIPTION OF THE PREFERRED EMBODIMENT

Figure 1:
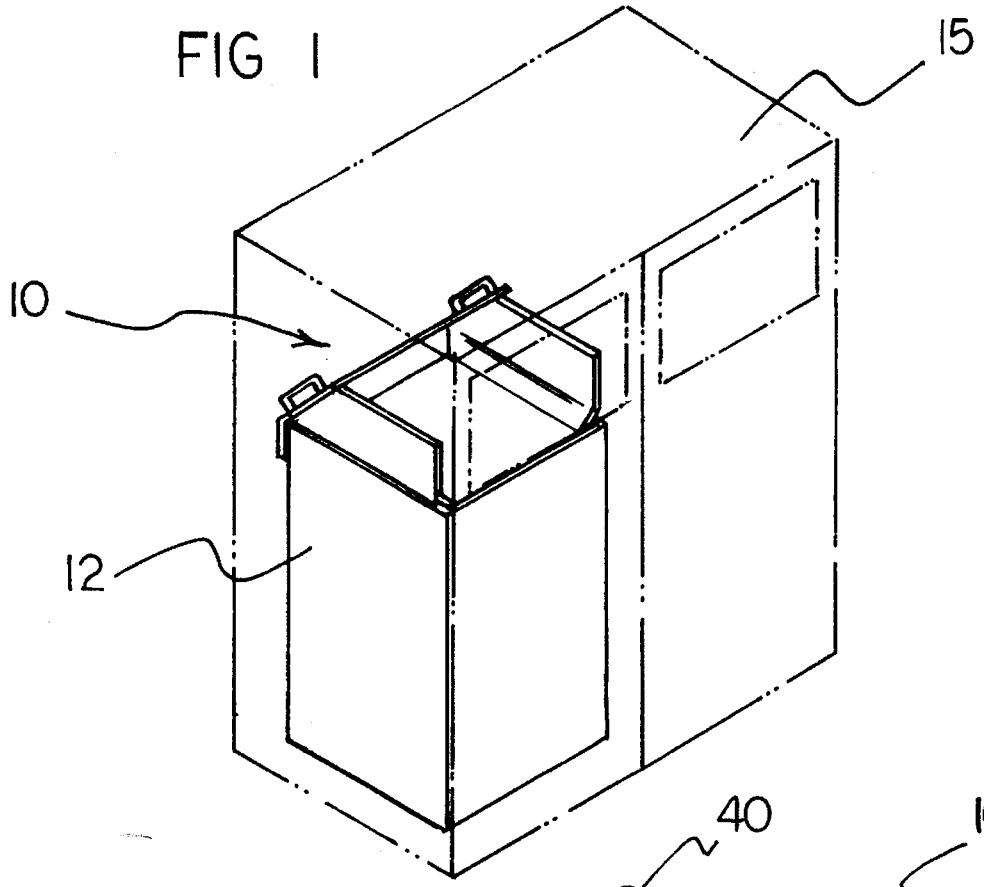
FIG. 1 is a perspective view showing a preferred embodiment of the refuse container attachment apparatus of the invention attached to a refuse container housed within a decorative housing.
Figure 2:
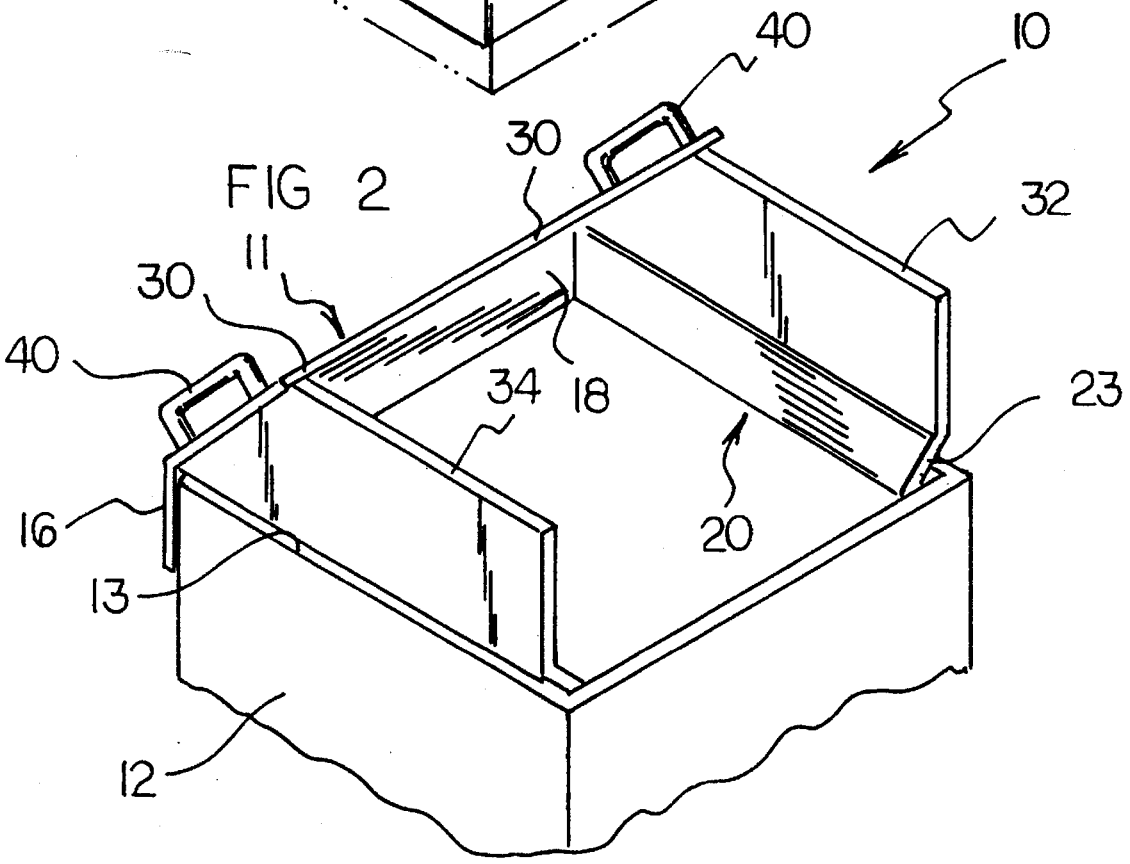
FIG. 2 is an enlarged perspective view of the refuse container attachment apparatus shown in FIG. 1 attached to the top of a refuse container.
Figure 5:
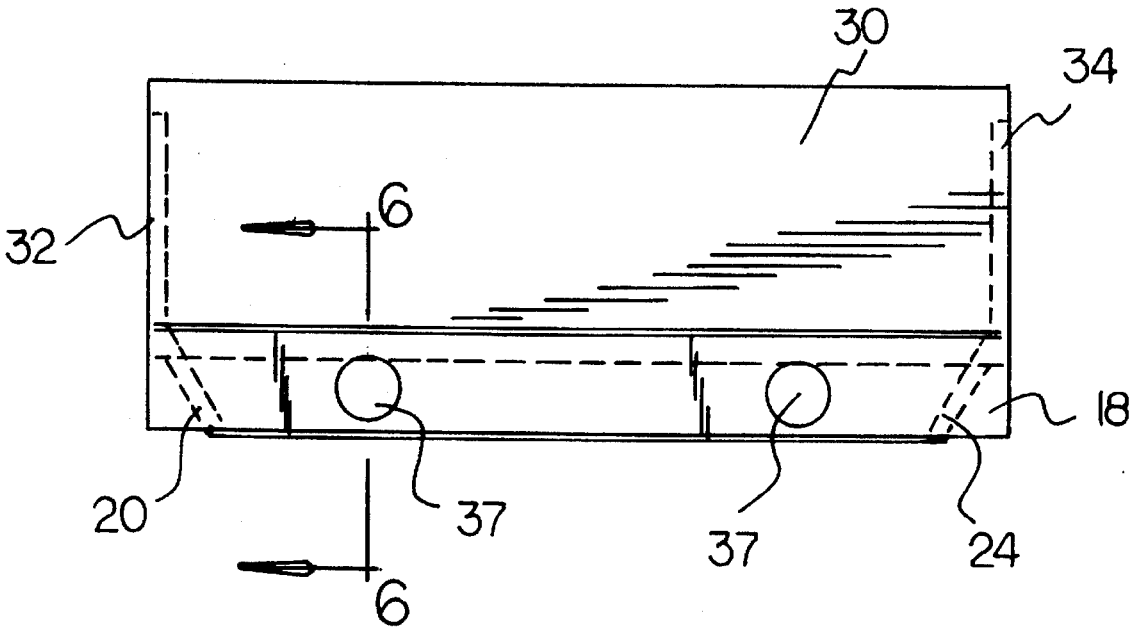
FIG. 5 is an enlarged rear view of the embodiment of the invention shown in FIG. 4.
Figure 6:
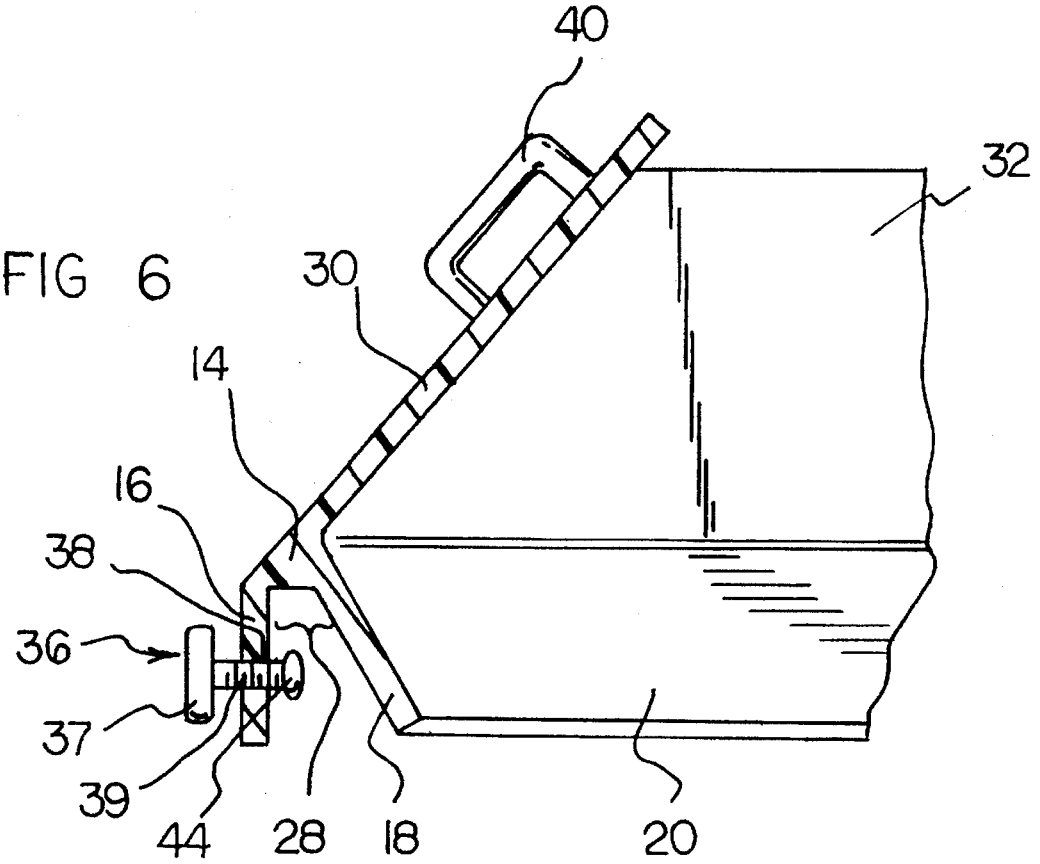
FIG. 6 is an enlarged cross-sectional view of the embodiment of the invention shown in FIG. 5 taken along line 6—6 thereof.

With reference to the drawings, a new and improved refuse container attachment apparatus embodying the principles and concepts of the present invention will be described.

Turning to FIGS. 1–6, there is shown an exemplary embodiment of the refuse container attachment apparatus of the invention generally designated by reference numeral 10. In its preferred form, refuse container attachment apparatus 10 includes a central base unit 11 which includes a base center portion 14, an outer base wall 16 downwardly depending from an outer side of the base center portion 14, and an inner base wall 18 downwardly depending from an inner side of the base center portion 14. The attachment apparatus 10 also includes a first side unit 20 which includes a rear end 21 and a front end 23, and the rear end 21 of the first side unit 20 is connected to a first end 22 of the central base unit 11. The attachment apparatus 10 also includes a second side unit 24 which includes a rear end 25 and a front end 27, and the rear end 25 of the second side unit 24 is connected to a second end 26 of the central base unit 11. The first side unit 20 slopes downwardly toward the second side unit 24, and the second side unit 24 slopes downwardly toward the first side unit 20. The inner base wall 18 of the base center portion 14 slopes downwardly toward the front ends of the first side unit 20 and the second side unit 24. The outer base wall 16, the base center portion 14, and the inner base wall 18 form an inverted U-shaped channel 28 for fitting over a top container rim 13 of a container 12.

A center deflector wall 30 is connected to the base center portion 14 and depends upwardly therefrom. The center deflector wall 30 slopes upwardly toward the front ends of the first side unit 20 and the second side unit 24. A first side deflector wall 32 is connected to the first side unit 20 and depends upwardly therefrom. A second side deflector wall 34 is connected to the second side unit 24 and depends upwardly therefrom. The central base unit 11, the first side unit 20, and the second side unit 24 are formed as a unified, integrated structure.

A clamp assembly is connected to the central base unit 11. The clamp assembly is used for clamping the attachment apparatus 10 onto the top container rim 13 of a container 12. The clamp assembly includes a screw clamp unit 36 which includes a handle portion 37 and a threaded shaft portion 39 which is connected to the handle portion 37. A threaded clamp-receiving channel 38 located in the outer base wall 16 of the central base unit 11. The threaded clamp-receiving channel 38 receives the threaded shaft portion 39 of the screw clamp unit 36. The clamp assembly further includes a pressure plate 41 located at a distal end of the threaded shaft portion 39. As shown in the drawings. a pair of clamp assemblies are employed. Carry handle 40 is connected to the center deflector wall 30. As shown in the drawings, a pair of carry handles 40 are employed.

In using the attachment apparatus 10 of the invention, a container 12 is selected, and the attachment apparatus 10 is placed over the top container rim 13. When this is done, the inner base wall 18 of the central base unit 11, the first side unit 20, and the second side unit 24 together form a funnel-like structure for funneling refuse into container. The handle portions 37 of the screw clamp units 36 are rotated so that the threaded shaft portions 39 and the pressure plates 41 advance toward the top container rim 13 and provide a clamping pressure on the top container rim 13.

The container 12 with the attached attachment apparatus 10 of the invention is placed in a decorative housing 15 such as shown in FIG. 1. When a door of the decorative housing 15 housing is opened and refuse in deposited directed into the container 12, any refuse that hits either the center deflector wall 30, the first side deflector wall 32, or the second side deflector wall 34 is deflected into the container 12. In this way, the inside walls of the decorative housing 15 are protected from refuse. When the container 12 is emptied, the attachment apparatus 10 can be detached from the container 12 by unscrewing the threaded shaft portions 39 of the screw clamp units 36. The attachment apparatus 10 can be carried by the carry handles 40. Then, the attachment apparatus 10 can be washed. After washing, the attachment apparatus 10 of the invention can be reattached to the top container rim 13 of the container 12. The first side deflector wall 32 and the second side deflector wall 34 serve to protect the inside walls of the decorative housing 15 from contact with refuse. They also serve to deflect refuse into the container 12. Furthermore, the center deflector wall 30 is sloped upward towards the front ends of the first side unit 20 and the second side unit 24. As a result, the center deflector wall 30 serves further to deflect refuse directly down into the container 12.

The components of the refuse container attachment apparatus of the invention can be made from inexpensive and durable metal and plastic materials. Plastic materials are preferred because they are washable and not subject to rusting.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved refuse container attachment apparatus that is low in cost, relatively simple in design and operation, and which may advantageously be used to impede or prevent accumulation of refuse or soil on inside walls of decorative housings for refuse containers. With the invention, a refuse container attachment apparatus is provided which reduces the amount of time spent for cleaning the inside walls of the decorative housings for refuse containers. With the invention, a refuse container attachment apparatus is provided which fits over the top rim of a refuse container and funnels refuse into the refuse container. With the invention, a refuse container attachment apparatus is provided which deflects refuse that overshoots the top rim of the refuse container into the interior of the refuse container. With the invention, a refuse container attachment apparatus is provided which is easily removed from the refuse container for washing. With the invention, a refuse container attachment apparatus is provided which is easily clamped onto a refuse container. With the invention, a refuse container attachment apparatus is provided which has handles so that refuse deflection means can be readily carried to and from a site where washing is conducted.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An apparatus, comprising:

a central base unit which includes a base center portion, an outer base wall downwardly depending from an outer side of said base center portion, and an inner base wall downwardly depending from an inner side of said base center portion, a first side unit which includes a rear end and a front end, wherein said rear end of said first side unit is connected to a first end of said central base unit, and a second side unit which includes a rear end and a front end, wherein said rear end of said second side unit is connected to a second end of said central base unit, wherein said first side unit slopes downwardly toward said second side unit, wherein said second side unit slopes downwardly toward said first side unit, and wherein said inner base wall of said base center portion slopes downwardly toward said front ends of said first side unit and said second side unit.

2. The apparatus of claim 1 wherein said outer base wall, said base center portion, and said inner base wall form an inverted U-shaped channel for fitting over a top container rim of a container.

3. The apparatus of claim 1, further including:

a center deflector wall connected to said base center portion and depending upwardly therefrom.

4. The apparatus of claim 3, further including:

a carry handle connected to said center deflector wall.

5. The apparatus of claim 3 wherein said center deflector wall slopes upwardly toward said front ends of said first side unit and said second side unit.

6. The apparatus of claim 1, further including:

a first side deflector wall connected to said first side unit and depending upwardly therefrom.

7. The apparatus of claim 1, further including:

a second side deflector wall connected to said second side unit and depending upwardly therefrom.

8. The apparatus of claim 1 wherein said central base unit, said first side unit, and said second side unit are formed as a unified, integrated structure.

9. The apparatus of claim 1, further including:

a clamp assembly connected to said central base unit.

10. The apparatus of claim 9 wherein said clamp assembly includes:

a screw clamp unit which includes a handle portion and a threaded shaft portion connected to said handle portion, and a threaded clamp-receiving channel located in said outer base wall of said central base unit, wherein said threaded clamp-receiving channel receives said threaded shaft portion of said screw clamp unit.

11. The apparatus of claim 10 wherein said clamp assembly further includes a pressure plate located at a distal end of said threaded shaft portion.

* * * * *